US011380240B2

(12) United States Patent
Qu et al.

(10) Patent No.: US 11,380,240 B2
(45) Date of Patent: Jul. 5, 2022

(54) DISPLAY CONTROL METHOD, TIMING CONTROLLER IC, AND DISPLAY DEVICE

(71) Applicants: HEFEI BOE DISPLAY TECHNOLOGY CO., LTD., Anhui (CN); BOE TECHNOLOGY GROUP CO., LTD., Beijing (CN)

(72) Inventors: Zhenlin Qu, Beijing (CN); Liugang Zhou, Beijing (CN); Ke Dai, Beijing (CN); Tao Li, Beijing (CN); Yulong Xiong, Beijing (CN); Yizhan Han, Beijing (CN); Jianwei Sun, Beijing (CN); Liu He, Beijing (CN); Yunyun Liang, Beijing (CN); Jun Wang, Beijing (CN); Qing Li, Beijing (CN); Xutong Chen, Beijing (CN); Liwei Zhou, Beijing (CN); Xiaofeng Yin, Beijing (CN)

(73) Assignees: HEFEI BOE DISPLAY TECHNOLOGY CO., LTD., Hefei (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/908,283

(22) Filed: Jun. 22, 2020

(65) Prior Publication Data

US 2021/0012699 A1 Jan. 14, 2021

(30) Foreign Application Priority Data

Jul. 11, 2019 (CN) ..... 201910624346.1

(51) Int. Cl.
*G09G 3/20* (2006.01)
*G09G 3/34* (2006.01)

(52) U.S. Cl.
CPC ..... *G09G 3/2007* (2013.01); *G09G 3/3426* (2013.01); *G09G 2310/08* (2013.01);
(Continued)

(58) Field of Classification Search
CPC ..... G09G 3/2007; G09G 3/3426; G09G 2310/08; G09G 2320/0233; G09G 2320/0285; G09G 2320/029
See application file for complete search history.

(56) References Cited

U.S. PATENT DOCUMENTS

2007/0296689 A1* 12/2007 Kimura ..... G09G 3/3426 345/102
2014/0125714 A1* 5/2014 Pyo ..... G09G 3/3233 345/691

(Continued)

*Primary Examiner* — Chanh D Nguyen
*Assistant Examiner* — Ngan T. Pham-Lu
(74) *Attorney, Agent, or Firm* — McCoy Russell LLP

(57) ABSTRACT

The preset disclosure provides a display control method, a timing controller IC and a display device. The method includes: acquiring a preset grayscale voltage of a target pixel unit and a backlight brightness of a backlight region corresponding to the target pixel unit, in a current output display frame; outputting a first grayscale voltage to the target pixel unit if the backlight brightness of the corresponding backlight region is less than or equal to a first preset brightness value; outputting a second grayscale voltage to the target pixel unit if the backlight brightness of the corresponding backlight region is greater than the first preset brightness value; wherein the second grayscale voltage is greater than the first grayscale voltage, and both the second grayscale voltage and the first grayscale voltage are greater than the preset grayscale voltage.

16 Claims, 5 Drawing Sheets

(52) U.S. Cl.
CPC ..... *G09G 2320/029* (2013.01); *G09G 2320/0233* (2013.01); *G09G 2320/0285* (2013.01)

(56) References Cited

U.S. PATENT DOCUMENTS

| | | | | |
|---|---|---|---|---|
| 2019/0333456 | A1* | 10/2019 | Lim | G09G 3/3406 |
| 2020/0302883 | A1* | 9/2020 | Watanabe | G09G 3/3607 |

* cited by examiner previous frame current frame

| tabled | 0 | 8 | 16 | 32 | 48 | 64 | 80 | 96 | 112 | 128 | 144 | 160 | 176 | 192 | 208 | 224 | 240 | 248 | 255 |
|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 |
| 8 | 9 | 9 | 9 | 9 | 8 | 8 | 8 | 8 | 8 | 8 | 8 | 8 | 8 | 8 | 8 | 8 | 7 | 7 | 7 |
| 16 | 18 | 18 | 18 | 17 | 17 | 16 | 16 | 16 | 16 | 16 | 16 | 15 | 15 | 15 | 15 | 15 | 15 | 15 | 14 |
| 32 | 36 | 36 | 35 | 34 | 33 | 32 | 32 | 32 | 32 | 31 | 31 | 30 | 30 | 30 | 30 | 30 | 29 | 29 | 28 |
| 48 | 53 | 53 | 52 | 51 | 50 | 49 | 49 | 48 | 48 | 47 | 47 | 46 | 46 | 46 | 45 | 45 | 44 | 44 | 43 |
| 64 | 69 | 69 | 69 | 68 | 67 | 66 | 65 | 64 | 64 | 63 | 63 | 62 | 62 | 62 | 61 | 60 | 59 | 58 | 57 |
| 80 | 88 | 87 | 87 | 85 | 84 | 83 | 82 | 81 | 81 | 80 | 80 | 79 | 79 | 78 | 77 | 76 | 75 | 74 | 72 |
| 96 | 106 | 105 | 104 | 102 | 101 | 99 | 98 | 97 | 97 | 96 | 96 | 95 | 95 | 94 | 93 | 92 | 90 | 89 | 87 |
| 112 | 124 | 123 | 122 | 120 | 118 | 116 | 115 | 114 | 114 | 113 | 113 | 112 | 112 | 111 | 110 | 108 | 106 | 105 | 104 |
| 128 | 141 | 140 | 139 | 137 | 135 | 133 | 132 | 131 | 130 | 129 | 129 | 128 | 128 | 128 | 126 | 124 | 122 | 121 | 120 |
| 144 | 156 | 156 | 155 | 153 | 152 | 150 | 149 | 148 | 147 | 146 | 145 | 144 | 144 | 144 | 143 | 141 | 139 | 138 | 137 |
| 160 | 171 | 171 | 170 | 169 | 168 | 167 | 166 | 165 | 164 | 162 | 161 | 160 | 160 | 160 | 159 | 158 | 156 | 155 | 153 |
| 176 | 186 | 186 | 186 | 185 | 184 | 184 | 183 | 183 | 181 | 179 | 178 | 177 | 177 | 176 | 176 | 175 | 174 | 173 | 171 |
| 192 | 201 | 201 | 201 | 200 | 200 | 200 | 200 | 200 | 198 | 196 | 195 | 194 | 193 | 192 | 192 | 192 | 191 | 190 | 189 |
| 208 | 216 | 216 | 216 | 215 | 215 | 215 | 215 | 215 | 213 | 212 | 211 | 210 | 209 | 208 | 208 | 208 | 208 | 207 | 207 |
| 224 | 230 | 230 | 230 | 229 | 229 | 229 | 229 | 229 | 226 | 227 | 226 | 225 | 225 | 224 | 224 | 224 | 224 | 224 | 223 |
| 240 | 243 | 243 | 243 | 242 | 242 | 242 | 242 | 242 | 242 | 241 | 241 | 240 | 240 | 240 | 240 | 240 | 240 | 240 | 240 |
| 248 | 249 | 249 | 249 | 249 | 249 | 249 | 249 | 249 | 249 | 248 | 248 | 248 | 248 | 248 | 248 | 248 | 248 | 248 | 248 |
| 255 | 255 | 255 | 255 | 255 | 255 | 255 | 255 | 255 | 255 | 255 | 255 | 255 | 255 | 255 | 255 | 255 | 255 | 255 | 255 |

Fig. 5

DISPLAY CONTROL METHOD, TIMING CONTROLLER IC, AND DISPLAY DEVICE

CROSS-REFERENCE TO RELATED APPLICATION

The present application claims the priority of Chinese Patent Application No. 201910624346.1 filed on Jul. 11, 2019, the contents of which are incorporated herein in their entirety by reference.

TECHNICAL FIELD

The present disclosure relates to the field of display technology, and in particular to a display control method, a timing controller IC and a display device.

BACKGROUND

Currently, some backlight modules (BLUs) are driven by light emitting diode (LED) light bars in a local dimming mode. The local dimming is a technique of dividing the image signals of the display device into multiple regions based on the backlight, and perform analysis and calculation according to the image brightness of each region to realize automatic control of the backlight brightness of each region.

On the display panel located above the backlight module, an active layer is provided below the data lines, and the active layer has a conductor characteristic under illumination; since the light and dark states of the backlight regions corresponding to the backlight module are switched frequently, the voltages on the data lines vary under different illumination intensities due to the influence of the conductor characteristic of the active layer, causing different degrees of data delay and producing differences in charge levels of the display of the pixel units of the display panel, resulting in a horizontal block on a monochrome image, i.e. water fall phenomenon.

SUMMARY

The embodiments of the present disclosure provides a display control method. The method includes:

acquiring a preset grayscale voltage of a target pixel unit and a backlight brightness of a backlight region corresponding to the target pixel unit, in a current output display frame;

outputting a first grayscale voltage to the target pixel unit if the backlight brightness of the corresponding backlight region is less than or equal to a first preset brightness value; outputting a second grayscale voltage to the target pixel unit if the backlight brightness of the corresponding backlight region is greater than the first preset brightness value;

wherein the second grayscale voltage is greater than the first grayscale voltage, and both the second grayscale voltage and the first grayscale voltage are greater than the preset grayscale voltage.

Optionally, the display control method further includes:

outputting a third grayscale voltage to the target pixel unit if the backlight brightness of the corresponding backlight region is greater than or equal to a second preset brightness value;

wherein the second preset brightness value is greater than the first preset brightness value, and the third grayscale voltage is greater than the second grayscale voltage.

Optionally, the display control method further includes:

acquiring an actual grayscale voltage of the target pixel unit in an output display frame immediately previous to the current output display frame;

determining the first grayscale voltage, the second grayscale voltage, or the third grayscale voltage according to a compensation parameter table related to backlight brightness.

Optionally, according to the display control method, different compensation parameter tables are retrieved respectively, in cases that the backlight brightness of the backlight region is less than or equal to the first preset brightness value, that the backlight brightness of the backlight region is greater than the first preset brightness value and less than the second preset brightness value, and that the backlight brightness of the backlight region is greater than or equal to the second preset brightness value.

Optionally, grayscale voltage values prestored in the compensation parameter table correspond to different combinations of the actual grayscale voltage and the preset grayscale voltage, respectively.

Optionally, the greater a difference between one of the first, the second and the third grayscale voltages determined according to the compensation parameter table related to backlight brightness and the preset grayscale voltage is, the greater a difference between the actual grayscale voltage and the preset grayscale voltage is.

Optionally, the display control method further includes:

retrieving the compensation parameter table by a memory IC of the display device simultaneously when acquiring the backlight brightness of the backlight region corresponding to the target pixel unit.

Optionally, the step of acquiring the backlight brightness of the backlight region corresponding to the target pixel unit includes:

acquiring backlight control information of the current output display frame transmitted by a system controller IC of a display device;

determining the backlight brightness of the backlight region corresponding to the target pixel unit according to the backlight control information.

An embodiment of the present disclosure further provides a timing controller IC applied to a display device, wherein the timing controller IC includes:

an information acquisition circuit configured to acquire a preset grayscale voltage of a target pixel unit and a backlight brightness of a backlight region corresponding to the target pixel unit, in a current output display frame; and a grayscale voltage output circuit configured to output a first grayscale voltage to the target pixel unit if the backlight brightness of the corresponding backlight region is less than or equal to a first preset brightness value, or to output a second grayscale voltage to the target pixel unit if the backlight brightness of the corresponding backlight region is greater than the first preset brightness value;

wherein the second grayscale voltage is greater than the first grayscale voltage, and both the second grayscale voltage and the first grayscale voltage are greater than the preset gray scale voltage.

Optionally, in the timing controller IC, the grayscale voltage output circuit is further configured to output a third grayscale voltage to the target pixel unit if the backlight brightness of the corresponding backlight region is greater than or equal to a second preset brightness value;

wherein the second preset brightness value is greater than the first preset brightness value, and the third grayscale voltage is greater than the second grayscale voltage.

Optionally, in the timing controller IC, the grayscale voltage output circuit is further configured to:

acquire an actual grayscale voltage of the target pixel unit in an output display frame immediately previous to the current output display frame;

determine the first grayscale voltage, the second grayscale voltage, or the third grayscale voltage according to a compensation parameter table related to backlight brightness.

Optionally, in the timing controller IC, in cases that the backlight brightness of the backlight region is less than or equal to the first preset brightness value, that the backlight brightness of the backlight region is greater than the first preset brightness value and less than the second preset brightness value, and that the backlight brightness of the backlight region is greater than or equal to the second preset brightness value, different compensation parameter tables are retrieved, respectively.

Optionally, in the timing controller IC, grayscale voltage values prestored in the compensation parameter table correspond to different combinations of the actual grayscale voltage and the preset grayscale voltage respectively.

Optionally, in the timing controller IC, the greater a difference between one of the first, the second and the third grayscale voltages determined according to the compensation parameter table related to backlight brightness and the preset grayscale voltage is, the greater a difference between the actual grayscale voltage and the preset grayscale voltage is.

Optionally, in the timing controller IC, the information acquisition circuit is further configured to:

retrieve the compensation parameter table by a memory IC of the display device simultaneously when acquiring the backlight brightness of the backlight region corresponding to the target pixel unit.

Optionally, in the timing controller IC, the information acquisition circuit is configured to:

acquire backlight control information of the current output display frame transmitted by a system controller IC of a display device; and determine the backlight brightness of the backlight region corresponding to the target pixel unit according to the backlight control information.

An embodiment of the present disclosure further provides a display device including any of the above timing controller IC.

Optionally, the display device further includes:

a system controller IC configured to transmit backlight control information and display control information of the current output display frame to the timing controller IC, wherein the display control information includes the preset grayscale voltage of the target pixel unit, and the backlight control information includes backlight brightness information of the backlight region corresponding to the target pixel unit.

BRIEF DESCRIPTION OF THE DRAWINGS

FIG. 5 is an example diagram of a compensation parameter table in this disclosure;

DETAILED DESCRIPTION

Detailed description will be made below with reference to the accompanying drawings and specific embodiments in order that the technical problems, technical solutions, and advantages to be solved by the present disclosure are clearer.

In order to solve the problem in the related art that the water fall phenomenon occurs when the local dimming technique is adopted in the backlight modules, an embodiment of the present disclosure provide a display control method. According to the display control method, a timing controller IC may acquire the backlight brightnesses of the backlight regions of the pixel units, and compensate the grayscale voltages of the pixel units according to the acquired backlight brightnesses to improve the charging rates of the pixel units and avoid the water fall phenomenon.

Figure 1:
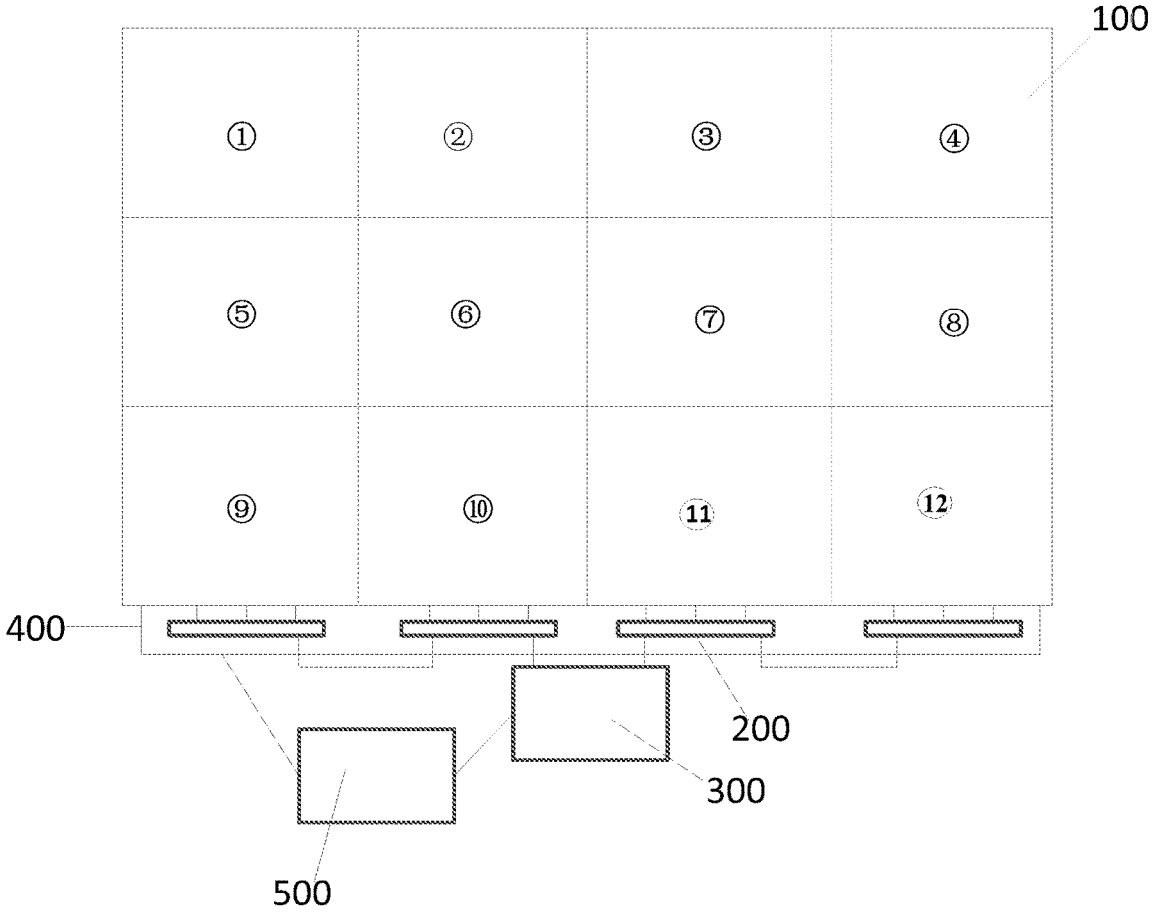
FIG. 1 is a schematic diagram of a connection structure of a display device to which a display control method according to an embodiment of the present disclosure is applied.

FIG. 1 is a schematic diagram of a connection structure of a display device to which a display control method according to an embodiment of the present disclosure is applied. Referring to FIG. 1, the display device using the display control method according to the embodiment of the present disclosure includes: a display module 100, a source driver IC 200, a timing controller IC 300, a backlight bar controller IC 400, and a system controller IC 500.

The display module 100 includes a backlight module and a display panel (not shown). The backlight module includes multiple LED lights and can achieve the local dimming of the backlight brightness.

The system controller IC 500 is connected to the backlight bar controller IC 400 and the timing controller IC 300, respectively, and can transmit backlight control information when each frame of image is displayed to the backlight bar controller IC 400 and transmit display control information when each frame of image is displayed to the timing controller IC 300. The timing controller IC 300 is connected to the source driver IC 200, and the source driver IC 200 is connected to data lines of the display module 100. Among then, the timing controller IC 300 can output driving voltages to the data lines in different regions of the source driver IC 200 according to the display control information of each displayed frame of image output by the system controller IC 500, so as to cause the display panel to display a corresponding image.

Furthermore, when the system controller IC 500 transmits the backlight control information when each frame of image is displayed to the backlight bar controller IC 400, the entire backlight area of the backlight module is controlled with respect to separated regions based on the input backlight control information. For example, as shown in FIG. 1, the entire backlight area may be divided into 4×3 regions, and each region can be switched between the bright state and the dark state by controlling the brightness of each divided region individually according to the backlight control information. Specifically, the division mode of the backlight regions of the backlight module which can be controlled individually and the number of the divided regions may be determined according to the requirement of the display device.

The display device of the above implemented structure in the embodiment of the present disclosure can achieve image display of large size and high resolution.

Figure 2:
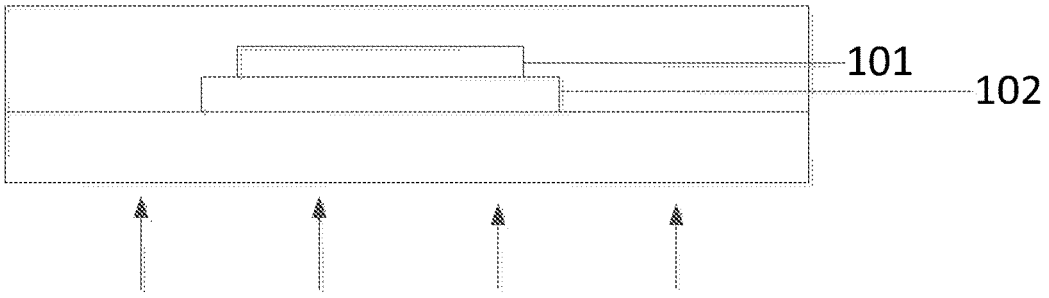
FIG. 2 is a structural diagram for explaining a positional relationship between data lines and an active layer in a display panel.
Figure 3:
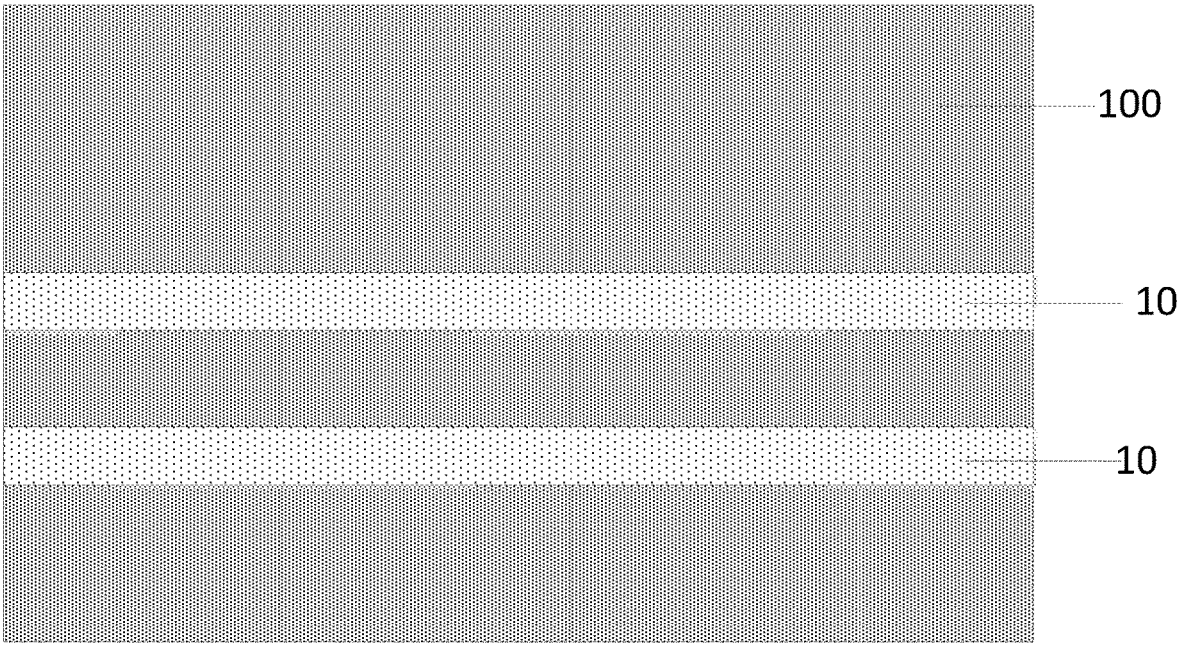
FIG. 3 is a schematic diagram showing a state of the water fall phenomenon of a display device.

Further, on the basis of the display device of the above implemented structure in which the backlight regions of the backlight module can be controlled in separated regions and need to be switched frequently between the bright state and the dark state, with reference to FIG. 2, since an active layer 102 provided below the data line 101 has a conductor characteristic, the voltage on the data line 101 may vary under different illumination intensity of the light of the backlight module, causing different degrees of data delay, which causes a difference in charge level of the pixel unit (the pixel unit has a lower charging rate when the corresponding backlight region is in the bright state compared with that when the corresponding backlight region is in the dark state), and thereby resulting in a horizontal block 10 as shown in FIG. 3, i.e. the water fall phenomenon.

In order to avoid the occurrence of the water fall phenomenon, the display control method according to the embodiment of the present disclosure is employed, wherein the timing controller IC 300 may acquire the backlight control information when each frame of image is displayed from the system controller IC 500, so as to determine the backlight brightness of the corresponding backlight region of the pixel unit according to the acquired backlight control information, and compensate a grayscale voltage to be output by the pixel unit according to the backlight brightness to improve the charging rate when the pixel unit is displaying the image, thereby avoiding the occurrence of the water fall phenomenon.

Figure 4:
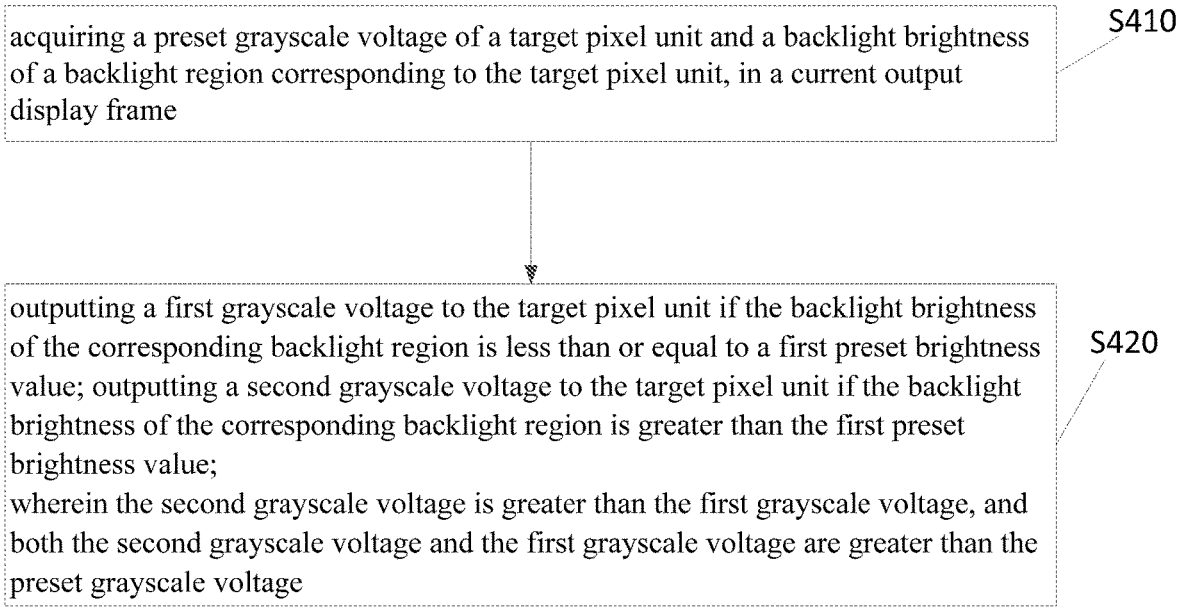
FIG. 4 is a schematic flowchart of a display control method according to an embodiment of the present disclosure.

Specifically, the display control method according to the embodiment of the disclosure is applied to the timing controller IC 300 of the display device as shown in the embodiment of FIG. 1. As shown in FIG. 4, the method includes:

S410, acquiring a preset grayscale voltage of a target pixel unit and a backlight brightness of a backlight region corresponding to the target pixel unit in a current output display frame;

S420, outputting a first grayscale voltage to the target pixel unit if the backlight brightness of the corresponding backlight region is less than or equal to a first preset brightness value; outputting a second grayscale voltage to the target pixel unit if the backlight brightness of the corresponding backlight region is greater than the first preset brightness value;

wherein the second grayscale voltage is greater than the first grayscale voltage, and both the second grayscale voltage and the first grayscale voltage are greater than the preset grayscale voltage.

According to the above method, it should be noted that, in step S410, the display control information of the current output display frame may be acquired from the system controller IC 500, and the grayscale voltage to be output to each pixel unit may be determined according to the display control information. Wherein, the target pixel unit is any pixel unit in the display panel. The preset grayscale voltage is the grayscale voltage to be output to the target pixel unit determined according to the display control information.

In the embodiment of the present disclosure, according to the backlight brightness of the backlight region corresponding to the target pixel unit, the grayscale voltage output to the target pixel unit is greater than the preset grayscale voltage of the target pixel unit so as to perform grayscale voltage compensation; further, compared with a backlight brightness that is less than or equal to the first preset brightness value, the backlight brightness of the backlight region corresponding to the pixel unit that is greater than the first preset brightness value corresponds a larger grayscale voltage output to the target pixel unit, so that the compensation for the grayscale voltage is different at different backlight brightnesses, ensuring that the charging rates are consistent even when the backlight states of the backlight regions corresponding to the entire display panel are different, and thereby effectively avoiding the occurrence of the water fall phenomenon.

Optionally, in the embodiment of the present disclosure, the first preset brightness may be a brightness value for defining the bright state and the dark state of the backlight region, and the specific numeric value may be determined according to an actual brightness requirement.

Optionally, the display control method according to the embodiment of the present disclosure further includes:

outputting a third grayscale voltage to the target pixel unit if the backlight brightness of the corresponding backlight region is greater than or equal to a second preset brightness value;

wherein the second preset brightness value is greater than the first preset brightness value, and the third grayscale voltage is greater than the second grayscale voltage.

It should be noted that, since the voltage on the data line is different under different illumination intensities of the backlight region, a difference in charge level of the display of the pixel unit in the display panel occurs, and the charging rate of the backlight region in the bright state is lower than that in the dark state, resulting in a horizontal block in a monochrome image. In view of this, by using the method according to the embodiment of the present disclosure, the grayscale voltages are varied depending upon the backlight brightness of different backlight regions, that is, when the backlight brightness is higher, the grayscale voltage output to the target pixel unit is also increased to compensate for the grayscale voltage of the target pixel unit. Thus, it is ensured that the charging rates are consistent even when the brightness of the backlight regions of different pixel units of the entire display panel are different.

It should be noted that, when a brightness control is performed on the divided backlight regions in the backlight module, a control mode may be used in which all the LED lights provided in each backlight region are in the bright state or the dark state (hereinafter referred to as a full bright state and a full dark state, respectively).

In the embodiment of the present disclosure, optionally, the first preset brightness value is slightly larger than the actual brightness value when the backlight region is in a full dark state, and the second preset brightness value is slightly lower than the actual brightness value when the backlight region is in a fully bright state.

It can be seen from the above embodiment that, the backlight states of the backlight region include a dark state in which the backlight brightness is less than or equal to the first preset brightness value, a bright state in which the backlight brightness is greater than or equal to the second preset brightness value, and an intermediate state in which the backlight brightness is less than or equal to the second preset brightness value and greater than or equal to the first preset brightness value. The grayscale voltage output to the target pixel unit is varied when the backlight state of the backlight region is varied, and as the backlight brightness is increased, the output grayscale voltage is also increased to ensure that the charging rates in the bright state and the dark state of the backlight regions corresponding to the entire display panel are consistent.

It should be noted that, when the brightness control is performed respectively on the divided backlight regions in the backlight module, the bright and dark states of a backlight region may not be limited to only the above three states, but may also include more than three states, according to different control modes as required and different brightness region division. When there are more states, according to the display control method in the embodiment of the present disclosure, a principle should be followed that the higher the brightness of the backlight region, the larger the grayscale voltage to be output, so as to ensure that the charging rates in the bright state and the dark state of the backlight regions corresponding to the entire display panel are consistent.

Optionally, the display control method according to the embodiment of the present disclosure further includes:

acquiring an actual grayscale voltage of the target pixel unit in an output display frame immediately previous to the current output display frame;

determining the first grayscale voltage, the second grayscale voltage, or the third grayscale voltage according to a compensation parameter table related to backlight brightness.

According to the embodiment of the present disclosure, in the cases that the backlight brightness of the backlight region is less than or equal to the first preset brightness value, that the backlight brightness of the backlight region is greater than the first preset brightness value and less than the second preset brightness value, and that the backlight brightness of the backlight region is greater than or equal to the second preset brightness value, different compensation parameter tables may be retrieved, respectively.

In addition, in the display control method according to the present disclosure, grayscale voltage values prestored in the compensation parameter table correspond to different combinations of the actual grayscale voltage and the preset grayscale voltage, respectively. In other words, as shown in the example of FIG. 5, the compensation parameter table may be a two-dimensional table, and respective grayscale voltage values prestored in the compensation parameter table for output correspond to different combinations of the actual grayscale voltage and the preset grayscale voltage, respectively.

Specifically, a compensation parameter table corresponding to different backlight brightness ranges is obtained through pretesting. According to the actual grayscale voltage of the previous output display frame of the target pixel unit and the preset grayscale voltage of the current output display frame, the corresponding grayscale voltage to be output (that is, one of the first grayscale voltage, the second grayscale voltage, or the third grayscale voltage) can be determined directly by using the compensation parameter table, so that the process of determining the grayscale voltage is simple and convenient, improving the display processing efficiency.

In the embodiment of the present disclosure, in the compensation parameter table, the greater the difference between the actual grayscale voltage and the preset grayscale voltage is, the larger the difference between the grayscale voltage to be output (i.e., one of the first grayscale voltage, the second grayscale voltage, or the third grayscale voltage determined according to the compensation parameter table related to backlight brightness) and the preset grayscale voltage is.

It should be noted that the actual grayscale voltage is a grayscale voltage actually output to the target pixel unit in the previous output display frame. According to the display control method in the embodiment of the present disclosure, when determining the grayscale voltage to be output to the target pixel unit, the actual grayscale voltage of the target pixel unit in the current output display frame is determined according to the backlight brightness of the backlight region corresponding to the target pixel unit, as well as the actual grayscale voltage of the previous output display frame, the backlight brightness of the backlight region corresponding to the target pixel unit in the current output display frame, and the preset grayscale voltage of the target pixel unit, so as to prevent the actual grayscale of the previous output display frame from influencing the charge rate of the pixel unit in the current output display frame.

In addition, it is proved by practical testing that the greater the difference between the actual grayscale voltage of the previous output display frame and the preset grayscale voltage of the current output display frame is, the larger the influence of the previous output display frame on the charging rate of current output display frame is, and thus, the greater the grayscale voltage compensation is required for the current output display frame. Therefore, in the embodiment of the present disclosure, for the target pixel unit, when the difference between the actual grayscale voltage of the previous output display frame and the preset grayscale voltage of the current output display frame is larger, the current output display frame is compensated with greater grayscale voltage by making the differences between the first and second grayscale voltages respectively determined and the preset grayscale voltage larger, respectively, thereby effectively ensuring that the charging rates in the bright state and the dark state of the backlight regions corresponding to the entire display panel are consistent.

Specifically, in the display control method according to the embodiment of the present disclosure:

the compensation parameter table includes: a first compensation parameter table for the case that the backlight brightness of the backlight region is less than or equal to the first preset brightness value; a second compensation parameter table for the case that the backlight brightness of the backlight region is greater than the first preset brightness value and less than the second preset brightness value; and a third compensation parameter table for the case that the backlight brightness of the backlight region is greater than or equal to the second preset brightness value.

The first compensation parameter table is used to store, for the target pixel unit, the values of the corresponding first grayscale voltages in the case that the actual grayscale voltage of the previous output display frame and the preset grayscale voltage of the current output display frame are different values when the backlight brightness is less than or equal to the first preset brightness value; the second compensation parameter table is used to store, for the target pixel unit, the values of the corresponding second grayscale voltages in the case that the actual grayscale voltage of the previous output display frame and the preset grayscale voltage of the current output display frame are different values when the backlight brightness is greater than the first preset brightness value and less than the second preset brightness value; and, the third compensation parameter table is used to store, for the target pixel unit, the values of the corresponding third grayscale voltages in the case that the actual grayscale voltage of the previous output display frame and the preset grayscale voltage of the current output display frame are different values when the backlight brightness is greater than or equal to the second preset brightness value.

If the backlight brightness of the backlight region corresponding to the target pixel unit is less than or equal to the first preset brightness value, the first grayscale voltage is determined according to the first compensation parameter table; if the backlight brightness of the backlight region corresponding to the target pixel unit is greater than the first preset brightness value and less than the second preset brightness value, the second grayscale voltage is determined according to the second compensation parameter table; and, if the backlight brightness of the backlight region corresponding to the target pixel unit is greater than or equal to the second preset brightness value, the third grayscale voltage is determined according to the third compensation parameter table.

It will be appreciated that, in the above compensation parameter tables, the greater the difference between the actual grayscale voltage of the previous output display frame and the preset grayscale voltage of the current output display frame is, the greater the difference between the first, second or third grayscale voltages determined correspondingly and the preset grayscale voltage.

It should be noted that, the determination of the grayscale voltage to be output to the target pixel unit using the compensation parameter table in the embodiment of the present disclosure has been described in case that the backlight brightness of the backlight region is divided into three states. In a case that the backlight brightness of the backlight region is divided into only two states of a dark state and a bright state by a first preset brightness value, the compensation parameter table may include only a first compensation parameter table corresponding to the dark backlight state (the backlight brightness is less than or equal to the first preset brightness value) and a second first compensation parameter table corresponding to the bright backlight state (the backlight brightness is greater than the first preset brightness value).

In the embodiment of the present disclosure, optionally, the method further includes:

retrieving the compensation parameter table by a memory IC simultaneously when acquiring the backlight state of the backlight region corresponding to the target pixel unit.

Specifically, with reference to FIG. 1, the memory IC may be provided independently of the timing controller IC 300, or may be integrated with the timing controller IC 300.

The specific implementation process of the display control method according to the embodiment of the present disclosure will be described in detail below with reference to FIGS. 1, 5, 6, and 7.

Assuming a display device using the display control method described in the embodiment of the present disclosure, in which the backlight area of the backlight module is divided into X×Y regions, e.g., 4×3 or 4×4 regions, and each backlight region is set to include a full bright state and a full dark state of the corresponding LED lights, that is, when all LED lights surrounding each backlight region are bright, the backlight region is in the bright state; when all LED lights surrounding each backlight region are dark, the backlight region is in the dark state. Each backlight region can be switched between the bright state and the dark state. The following will explain the process of the display control method in the embodiment of the present disclosure by taking an example in which the backlight state is divided into a bright state (the backlight brightness is greater than the first preset brightness value) and a dark state (the backlight brightness is less than or equal to the first preset brightness value).

In addition, optionally, the refresh frequency of the bright and dark states of the backlight module and the display refresh frequency of the display panel are kept consistent. Specifically, when the backlight module is refreshed between the bright and dark state, the brightness of each backlight region may be simultaneously switched according to the preset refresh frequency.

When the display device is displaying an image, the system controller IC 500 transmits information on the bright or dark state of each backlight region in the current output display frame to the backlight bar controller IC 400 and the timing controller IC 300. For example, when the display is initially turned on for display, the current output display frame is the first display frame.

Specifically, based on the information on the bright or dark state of each backlight region transmitted by the system controller IC 500, the backlight bar controller IC 400 controls the bright or dark state of the LED light bars of each backlight region to achieve the local dimming function. If the backlight area of the backlight module is divided into 4×3 regions, as shown in FIG. 1, according to the information on the bright or dark state of each backlight region transmitted by the system controller IC 500, in the current output display frame, the regions labeled 1, 3, 5, 7, 9 and 11 are in the dark state, and the regions labeled 2, 4, 6, 8, 10 and 12 are in the bright state; thus, under the illumination of corresponding backlight regions, the charging rates of the pixel units on the display panel corresponding to the backlight regions labeled 1, 3, 5, 7, 9 and 11 are greater than the charging rates of the pixel units corresponding to the backlight regions labeled 2, 4, 6, 8, 10 and 12.

Therefore, according to the above information on the bright or dark state of each backlight region, the backlight bar controller IC 400 retrieves the first compensation parameter table corresponding to the dark backlight region for the pixel units corresponding to the backlight regions labeled 1, 3, 5, 7, 9 and 11, so as to determine the grayscale voltage that should be output to each pixel unit in these regions according to the first compensation parameter table; and retrieves the second compensation parameter table corresponding to the bright backlight region for the pixel units corresponding to the backlight regions labeled 2, 4, 6, 8, 10 and 12, so as to determine the grayscale voltage that should be output to each pixel unit in these regions according to the second compensation parameter table.

It will be appreciated that, for a same pixel unit, when the preset grayscale voltage is the same value, the corresponding grayscale voltage in the second compensation parameter table is greater than the corresponding grayscale voltage in the first compensation parameter table.

Figure 6:
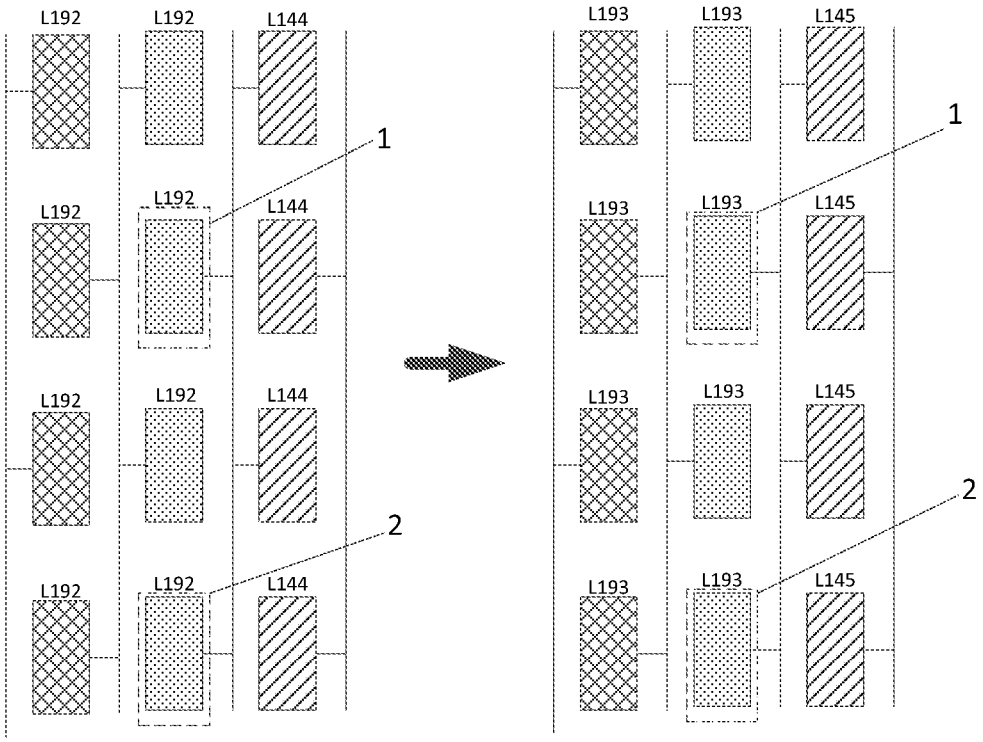
FIG. 6 is a schematic diagram of grayscale voltages of some pixel units in an embodiment of the present disclosure.
Figure 7:
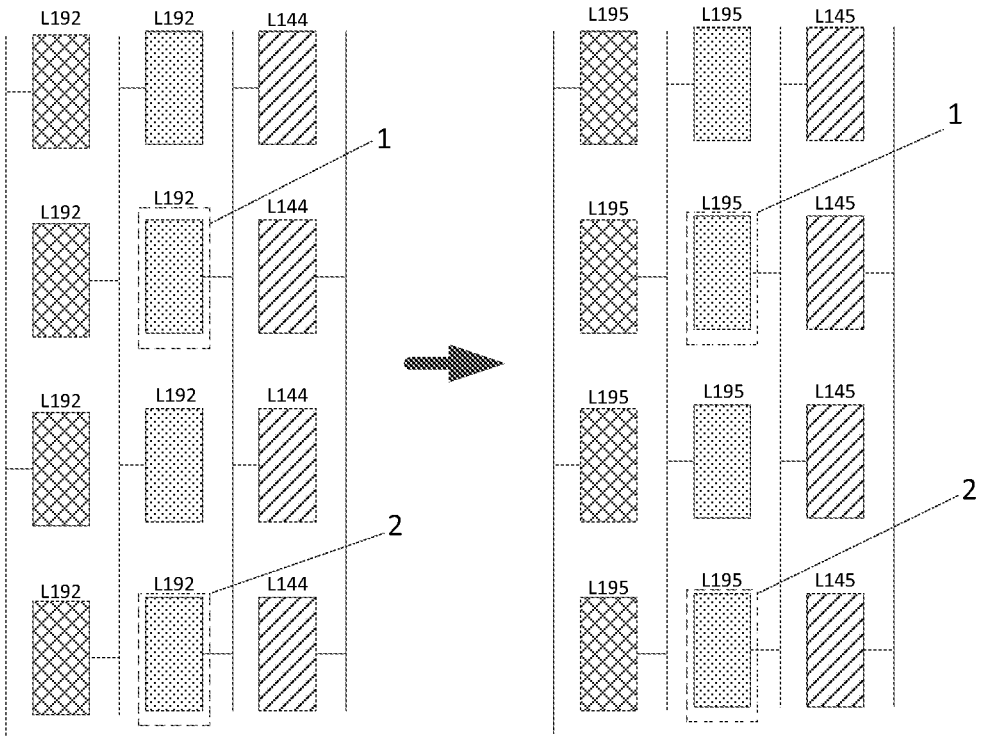
FIG. 7 is a schematic diagram of grayscale voltages of some pixel units in another embodiment of the present disclosure.

Specifically, as shown in FIG. 6, the pixel units in FIG. 6 are provided in a same backlight region. Taking the determination of the grayscale voltages of two pixel units in the backlight region in different backlight states as an example, as for the pixel unit 1 and the pixel unit 2 in the backlight region, when the corresponding backlight region is in the dark state, the preset grayscale voltage of the current output display frame is L192; according to the first compensation parameter table, it can be determined that the grayscale voltage to be output to the pixel units 1 and 2 is L193. Compared with this, referring to FIG. 7, when the corresponding backlight region is in the bright state, according to the first compensation parameter table, it can be determined that the grayscale voltage to be output to the pixel units is L195.

Similarly, as for the next output display frame, if the regions labeled 1, 2, 5, 7, 9 and 12 are in the dark state while the regions labeled 3, 4, 6, 8, 10 and 11 are in the bright state, the first compensation parameter table is retrieved for the pixel units corresponding to the regions labeled 1, 2, 5, 7, 9 and 12, and the grayscale voltage to be output to each pixel unit in these regions is determined according to the first compensation parameter table; for the pixel units corresponding to the regions labeled 3, 4, 6, 8, 10 and 11, the second compensation parameter table is retrieved, and the grayscale voltage to be output to each pixel unit in these regions is determined according to the second compensation parameter table.

Based on the above rules, the grayscale voltage output to each pixel unit at each output display frame can be determined.

Additionally, in the embodiment of the present disclosure, the first and the second compensation parameter tables retrieved by the timing controller IC 300 record therein a value of the grayscale voltage to be output when the actual grayscale voltage of the previous output display frame and the preset grayscale voltage of the current output display grame are different values, respectively.

Referring to FIG. 5, it illustrates a form of one of the compensation parameter tables. The first row in the compensation parameter table records multiple grayscale voltages (actual grayscale voltages) corresponding to the previous output display frame respectively, and the first column of the compensation parameter table records multiple grayscale voltages (preset grayscale voltages) corresponding to the current output display frame respectively. In this way, according to one of the grayscale voltages marked in the first row and one of the grayscale voltages marked in the first column, a vertical line passing the grayscale voltage marked in the first row and a horizontal line passing the grayscale voltage marked in the first column are made, and the value indicated by the cross position of the two lines is determined to the grayscale voltage to be output corresponding to the current output display frame.

For example, as for one of the pixel units, the actual grayscale voltage output in the previous output display frame is L96, and the preset grayscale voltage of the current output display frame is L128; when the grayscale voltage L128 is output to this pixel unit, the actually displayed grayscale cannot reach L128 due to the insufficient charging rate, and thus resulting in the water fall phenomenon. However, in the method according to the embodiment of the present disclosure, by retrieving the compensation parameter table, as shown in FIG. 5, it can be determined that the grayscale voltage L131 can be output to the pixel unit, so that the actual display effect reaches L128, thereby eliminating the water fall phenomenon.

Optionally, the numbers of the row and column in the compensation parameter table may be determined according to the display effect required by actual needs, such as 19×19, 9×9, or 33×33, etc.

Figure 8:
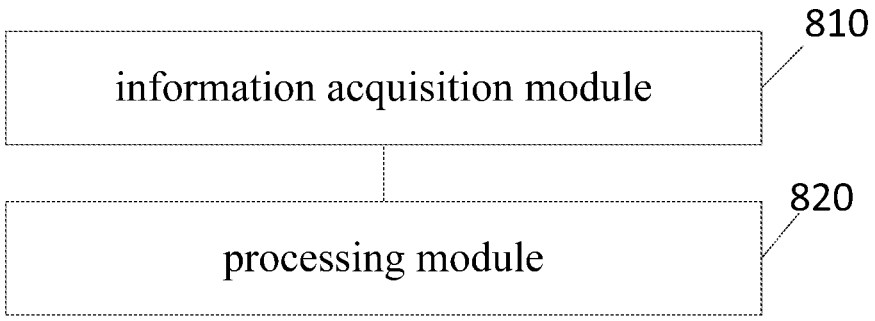
FIG. 8 is a structural diagram of a timing controller IC according to an embodiment of the present disclosure.

Another embodiment of the present disclosure further provides a timing controller IC applied to a display device. As shown in FIG. 8, the timing controller IC includes:

an information acquisition circuit 810 configured to acquire a preset grayscale voltage of a target pixel unit and a backlight brightness of a backlight region corresponding to the target pixel unit, in a current output display frame;

a grayscale voltage output circuit 820 configured to output a first grayscale voltage to the target pixel unit if the backlight brightness of the corresponding backlight region is less than or equal to a first preset brightness value, or to output a second grayscale voltage to the target pixel unit if the backlight brightness of the corresponding backlight region is greater than the first preset brightness value;

wherein the second grayscale voltage is greater than the first grayscale voltage, and both the second grayscale voltage and the first grayscale voltage are greater than the preset grayscale voltage.

The timing controller IC provided by the embodiment of the present disclosure can acquire the backlight brightnesses of the backlight regions of the pixel units, and perform, according to the acquired backlight brightnesses, different levels of compensation on the grayscale voltages of the pixel units to improve the charging rates of the pixel units and avoid the water fall phenomenon.

After determining the first or the second grayscale voltage, the timing controller IC may transmit the determined voltage information to the source driver IC 200, and the source driver IC 200 outputs the corresponding value of the determined grayscale voltage to a data line corresponding to the target pixel unit.

Optionally, in the timing controller IC, the grayscale voltage output circuit 820 is further configured to:

output a third grayscale voltage to the target pixel unit if the backlight brightness of the corresponding backlight region is greater than or equal to a second preset brightness value;

wherein the second preset brightness value is greater than the first preset brightness value, and the third grayscale voltage is greater than the second grayscale voltage.

Optionally, in the timing controller IC, the grayscale voltage output circuit 820 is further configured to:

acquire an actual grayscale voltage of the target pixel unit in an output display frame immediately previous to the current output display frame;

determine the first grayscale voltage, the second grayscale voltage, or the third grayscale voltage according to a compensation parameter table related to backlight brightness.

Optionally, in the timing controller IC, in cases that the backlight brightness of the backlight region is less than or equal to the first preset brightness value, that the backlight brightness of the backlight region is greater than the first preset brightness value and less than the second preset brightness value, and that the backlight brightness of the backlight region is greater than or equal to the second preset brightness value, different compensation parameter tables are retrieved, respectively.

Optionally, in the timing controller IC, grayscale voltage values prestored in the compensation parameter table correspond to different combinations of the actual grayscale voltage and the preset grayscale voltage, respectively.

Optionally, in the timing controller IC, in the compensation parameter table, the greater a difference between the actual grayscale voltage and the preset grayscale voltage is, the greater a difference between the grayscale voltage to be output (i.e., one of the first, the second and the third grayscale voltages determined according to the compensation parameter table related to backlight brightness) and the preset grayscale voltage is.

Optionally, in the timing controller IC, the information acquisition circuit 810 is further configured to:

retrieve the compensation parameter table by the memory IC in the display device simultaneously when acquiring the backlight brightness of the backlight region corresponding to the target pixel unit.

Optionally, in the timing controller IC, the information acquisition circuit 810 is configured to:

acquire backlight control information of the current output display frame transmitted by the system controller IC of the display device; and determine the backlight brightness of the backlight region corresponding to the target pixel unit according to the backlight control information.

An embodiment of the present disclosure further provides a display device which includes the timing controller IC according to any of the above.

Optionally, the display device further includes:

a system controller IC configured to transmit backlight control information and display control information of the current output display frame to the timing controller IC, wherein the display control information includes therein the preset grayscale voltage of the target pixel unit, and the backlight control information includes therein a backlight state of the backlight region corresponding to the target pixel unit.

The specific structure of the display device according to the embodiment of the present disclosure may refer to FIG. 1. Optionally, the system controller IC transmits the backlight control information and the display control information of the current output display frame to the timing controller IC through the I2C or SPI signal, and transmits the backlight control information to the backlight bar controller IC through the I2C or SPI signal.

In addition, according to the above detailed description, those skilled in the art can understand the specific implementation structure of the display device including the timing controller IC with the above functions, which will not be described in detail here. The above describes the preferred embodiments of the present disclosure. It should be noted that, for those skilled in the art, many improvements and modifications can be made without departing from the principles described in the present disclosure. These improvements and modifications should also be regarded as the protective scope of this disclosure.

What is claimed is:

1. A display control method, comprising:

acquiring a preset grayscale voltage of a target pixel unit and a backlight brightness of a backlight region corresponding to the target pixel unit, in a current output display frame, wherein the preset grayscale voltage is a grayscale voltage to be output to the target pixel unit determined according to a display control information;

outputting a first grayscale voltage to the target pixel unit if the backlight brightness of the corresponding backlight region is less than or equal to a first preset brightness value;

outputting a second grayscale voltage to the target pixel unit if the backlight brightness of the corresponding backlight region is greater than the first preset brightness value;

outputting a third grayscale voltage to the target pixel unit if the backlight brightness of the corresponding backlight region is greater than or equal to a second preset brightness value;

wherein the second grayscale voltage is greater than the first grayscale voltage, wherein the second preset brightness value is greater than the first preset brightness value, and the third grayscale voltage is greater than the second grayscale voltage;

the method further comprising:

acquiring an actual grayscale voltage of the target pixel unit in an output display frame immediately previous to the current output display frame;

determining the first grayscale voltage, the second grayscale voltage, or the third grayscale voltage according to a compensation parameter table related to backlight brightness, wherein different compensation parameter tables are retrieved respectively for the following cases: a case that the backlight brightness of the backlight region is less than or equal to the first preset brightness value, a case that the backlight brightness of the backlight region is greater than the first preset brightness value and less than the second preset brightness value, and a case that the backlight brightness of the backlight region is greater than or equal to the second preset brightness value;

wherein the compensation parameter tables comprise: a first compensation parameter table for the case that the backlight brightness of the backlight region is less than or equal to the first preset brightness value; a second compensation parameter table for the case that the backlight brightness of the backlight region is greater than the first preset brightness value and less than the second preset brightness value; and a third compensation parameter table for the case that the backlight brightness of the backlight region is greater than or equal to the second preset brightness value.

2. The display control method according to claim 1, wherein grayscale voltage values prestored in the compensation parameter table correspond to different combinations of the actual grayscale voltage and the preset grayscale voltage respectively.

3. The display control method according to claim 1, wherein, the greater a difference between one of the first, the second and the third grayscale voltages determined according to the compensation parameter table related to backlight brightness and the preset grayscale voltage is, the greater a difference between the actual grayscale voltage and the preset grayscale voltage is.

4. The display control method according to claim 1, further comprising:

retrieving the compensation parameter table by a memory IC of a display device simultaneously when acquiring the backlight brightness of the backlight region corresponding to the target pixel unit.

5. The display control method according to claim 4, wherein the step of acquiring the backlight brightness of the backlight region corresponding to the target pixel unit comprises:

acquiring backlight control information of the current output display frame transmitted by a system controller IC of the display device;

determining the backlight brightness of the backlight region corresponding to the target pixel unit according to the backlight control information.

6. The display control method according to claim 1, wherein the step of acquiring the backlight brightness of the backlight region corresponding to the target pixel unit comprises:

acquiring backlight control information of the current output display frame transmitted by a system controller IC of a display device;

determining the backlight brightness of the backlight region corresponding to the target pixel unit according to the backlight control information.

7. The display control method according to claim 1, wherein in the case that the backlight brightness of the backlight region is less than or equal to the first preset brightness value, the first grayscale voltage is determined according to a first compensation parameter table; in the case that the backlight brightness of the backlight region is greater than the first preset brightness value and less than the second preset brightness value, the second grayscale voltage is determined according to a second compensation parameter table; and in the case that the backlight brightness of the backlight region is greater than or equal to the second preset brightness value, the third grayscale voltage is determined according to a third compensation parameter table.

8. The display control method according to claim 7, wherein the first compensation parameter table is used to store, for the target pixel unit, the values of the corresponding first grayscale voltages in the case that the actual grayscale voltage of the previous output display frame and the preset grayscale voltage of the current output display frame are different values when the backlight brightness is less than or equal to the first preset brightness value;

the second compensation parameter table is used to store, for the target pixel unit, the values of the corresponding second grayscale voltages in the case that the actual grayscale voltage of the previous output display frame and the preset grayscale voltage of the current output display frame are different values when the backlight brightness is greater than the first preset brightness value and less than the second preset brightness value; and, the third compensation parameter table is used to store, for the target pixel unit, the values of the corresponding third grayscale voltages in the case that the actual grayscale voltage of the previous output display frame and the preset grayscale voltage of the current output display frame are different values when the backlight brightness is greater than or equal to the second preset brightness value.

9. A timing controller IC applied to a display device, comprising:

an information acquisition circuit configured to acquire a preset grayscale voltage of a target pixel unit and a backlight brightness of a backlight region corresponding to the target pixel unit, in a current output display frame, wherein the preset grayscale voltage is a grayscale voltage to be output to the target pixel unit determined according to a display control information; and a grayscale voltage output circuit configured to output a first grayscale voltage to the target pixel unit if the backlight brightness of the corresponding backlight region is less than or equal to a first preset brightness value, output a second grayscale voltage to the target pixel unit if the backlight brightness of the corresponding backlight region is greater than the first preset brightness value, output a third grayscale voltage to the target pixel unit if the backlight brightness of the corresponding backlight region is greater than or equal to a second preset brightness value;

wherein the grayscale voltage output circuit is further configured to:

acquire an actual grayscale voltage of the target pixel unit in an output display frame immediately previous to the current output display frame;

determine the first grayscale voltage, the second grayscale voltage, or the third grayscale voltage according to a compensation parameter table related to backlight brightness, wherein different compensation parameter tables are retrieved respectively for the following cases; a case that the backlight brightness of the backlight region is less than or equal to the first preset brightness value, a case that the backlight brightness of the backlight region is greater than the first preset brightness value and less than the second preset brightness value, and a case that the backlight brightness of the backlight region is greater than or equal to the second preset brightness value, wherein the compensation parameter tables comprise: a first compensation parameter table for the case that the backlight brightness of the backlight region is less than or equal to the first preset brightness value; a second compensation parameter table for the case that the backlight brightness of the backlight region is greater than the first preset brightness value and less than the second preset brightness value; and a third compensation parameter table for the case that the backlight brightness of the backlight region is greater than or equal to the second preset brightness value;

wherein the second grayscale voltage is greater than the first grayscale voltage, the second preset brightness value is greater than the first preset brightness value, and the third grayscale voltage is greater than the second grayscale voltage.

10. The timing controller IC according to claim 9, wherein grayscale voltage values prestored in the compensation parameter table correspond to different combinations of the actual grayscale voltage and the preset grayscale voltage respectively.

11. The timing controller IC according to claim 9, wherein, the greater a difference between one of the first, the second and the third grayscale voltages determined according to the compensation parameter table related to backlight brightness and the preset grayscale voltage is, the greater a difference between the actual grayscale voltage and the preset grayscale voltage is.

12. The timing controller IC according to claim 9, wherein the information acquisition circuit is further configured to:

retrieve the compensation parameter table by a memory IC of the display device simultaneously when acquiring the backlight brightness of the backlight region corresponding to the target pixel unit.

13. The timing controller IC according to claim 12, wherein the information acquisition circuit is configured to:

acquire backlight control information of the current output display frame transmitted by a system controller IC of a display device; and determine the backlight brightness of the backlight region corresponding to the target pixel unit according to the backlight control information.

14. The timing controller IC according to claim 9, wherein the information acquisition circuit is configured to:

acquire backlight control information of the current output display frame transmitted by a system controller IC of a display device; and determine the backlight brightness of the backlight region corresponding to the target pixel unit according to the backlight control information.

15. A display device comprising the timing controller IC according to claim 9 and a display panel, the display panel comprising data lines and an active layer arranged below the data lines.

16. The display device according to claim 15, further comprising:

a system controller IC configured to transmit backlight control information and display control information of the current output display frame to the timing controller IC, wherein the display control information comprises the preset grayscale voltage of the target pixel unit, and the backlight control information comprises backlight brightness information of the backlight region corresponding to the target pixel unit.

* * * * *